US007663461B2

(12) United States Patent
Brosig-Rodríguez et al.

(10) Patent No.: US 7,663,461 B2
(45) Date of Patent: Feb. 16, 2010

(54) MODULAR TANK COUPLED TO A SELF-ASSEMBLY CABINET FOR GROUND LEVEL TRANSFORMERS

(75) Inventors: Héctor Manuel Brosig-Rodríguez, Escobedo (MX); Demófilo Maldonado-Cortés, San Pedro Centro Garza García (MX); José Gerardo Treviño-Ortíz, Garza García (MX); Raúl Treviño-Montalvo, Guadalupe (MX)

(73) Assignee: Prolec GE. S. de R.L. de C.V., Apodaca, N.L. (MX)

( * ) Notice: Subject to any disclaimer, the term of this patent is extended or adjusted under 35 U.S.C. 154(b) by 387 days.

(21) Appl. No.: 11/270,162

(22) Filed: Nov. 10, 2005

(65) Prior Publication Data

US 2007/0102180 A1 May 10, 2007

(51) Int. Cl.
*H01F 27/02* (2006.01)

(52) U.S. Cl. ..... 336/94; 336/90; 174/50
(58) Field of Classification Search ..... 336/94
See application file for complete search history.

(56) References Cited

U.S. PATENT DOCUMENTS

| | | | | |
|---|---|---|---|---|
| 1,332,666 | A * | 3/1920 | Horton | 190/4 |
| 3,014,158 | A | 12/1961 | Nelson et al. | |
| 3,376,086 | A | 4/1968 | Fischer | |
| 4,556,758 | A | 12/1985 | Warden | |
| 5,527,988 | A | 6/1996 | Hernandez et al. | |
| 6,422,612 | B1 | 7/2002 | Hays et al. | |

FOREIGN PATENT DOCUMENTS

JP 08102420 A * 4/1996

* cited by examiner

*Primary Examiner*—Elvin G Enad
*Assistant Examiner*—Joselito Baisa
(74) *Attorney, Agent, or Firm*—Egbert Law Offices PLLC

(57) ABSTRACT

The present invention is a modular tank coupled to a self-assembly cabinet for ground level transformers. The modular tank includes two interconnected tanks, a front plate and a base. The first tank is larger than the second one and contains the high tension elements. The second tank contains the low tension elements. The front plate supports the electric contacts for both tanks. The base supports the first tank and allows lifting above the ground. The self-assembly cabinet for ground level transformer has a cover divided into two sections. The first section acts as a cover for the modular tank, while the second section acts as a cover for the cabinet. Both cover sections are joined together by a hinge mechanism, and are assembled by sliding on top of the modular tank by a lateral rail mechanism.

5 Claims, 2 Drawing Sheets

MODULAR TANK COUPLED TO A SELF-ASSEMBLY CABINET FOR GROUND LEVEL TRANSFORMERS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This invention relates generally to transformers and more specifically to a modular tank coupled to a self-assembly cabinet for ground level transformers.

BACKGROUND OF THE INVENTION

Ground level three phase electrical power distribution transformer installations need to be protected against changing weather conditions as well as against acts of vandalism. For this reason, various housings and protective equipments have been used over the years. One of the desired characteristics of the housing employed is that it must restrict the access to the transformer and its related components only to authorized operating and maintenance personnel, without obstructing in any way the work that these personnel need to do. Various types of transformer housings have been reported in the patent literature.

For instance, U.S. Pat. No. 3,014,158 discloses a ground level transformer adapted primarily for use in conjunction with underground distribution systems, which is self-contained, not requiring either a separate enclosure or separate protective equipment for its installation, having all its live parts enclosed in a locked tamper-proof housing. The transformer housing contains two compartments, one of which contains oil, a transformer and its associated circuitry, as well as a switch and a fuse. The other compartment contains high and low voltage bushings which are electrically connected with the transformer, as well as manually operable means to connect or disconnect from the transformer circuitry the switch located inside the oil-containing compartment, as well as to remove or insert the fuse elements into the latter compartment.

U.S. Pat. No. 3,335,380 discloses a ground level transformer with cabinet. The invention relates particularly to housings for a three phase, ground level distribution transformer and associated switching and protective equipment, which can be shipped in knocked-down condition and is modular in construction. The invention provides also a cabinet for the switching and protective equipment which is unitary with the transformer casing and can be expanded to the left or to the right of the transformer casing to the extent desired. The cabinet is tamper-proof and weatherproof, and allows an unobstructed access to the equipment for the easy mounting of fuses, switches, lightning arresters, meters and potheads at any desired location within the cabinet.

U.S. Pat. No. 3,376,086 discloses a tamper-proof and weatherproof housing for enclosing an electrical apparatus at ground level, which allows simultaneous access to the apparatus from three sides and from the top of the housing. An adequate ventilation system for the electrical apparatus enclosed by the housing is also provided.

U.S. Pat. No. 3,870,932 discloses a terminal compartment cover means for pad-mounted transformers of the type having a tank integral with high and low voltage terminating compartments. The high voltage and low voltage segments of the compartment are enclosed by separated cover means, in a manner which permits isolation of the high voltage segment when the low voltage segment is opened. Each cover is of an inverted L-shaped cross section when closed, hinged along its upper edge to the tank and padlocked at its lower edge. The high voltage segment cover has a barrier facing the low voltage side which prevents access to the high voltage terminals. Inter-fitting water drainage channel means are provided on the two covers.

U.S. Pat. No. 4,556,758 discloses a pad-mounted transformer having an improved terminal cover-to-tank interface, which is formed by two equal, opposite facing acute angles in the cover, and a single obtuse angle in the adjacent tank. Closure of the terminal cover causes a leg of the obtuse angle to enter the vertex of an acute angle, which creates a tortuous path for elongated foreign objects, such as a wire, providing also a sloping surface which causes pry-bars to slide out of the interface seam. The cover-to-tank interface requires no welding, it forms no blind spots which resist application of paint, and it forms no moisture traps, thus greatly improving the corrosion resistance of the pad-mounted transformer. The tamper-resistance of the tank-terminal cover interface is also enhanced, as it creates a tortuous path for a wire, causing it to be sharply bent, and then directed into a box-like enclosure, against a harmless flat portion of the tank wall.

U.S. Pat. No. 5,189,257 discloses a transformer having an integral cabinet with an apparatus for hinging and clamping the cover of the cabinet onto its base. The hinge is formed by an L-shaped member extending from a lip surrounding a planar top formed in the cover. A flange having rearward and downward extending portions extends from the rear wall of the cabinet base. The hinge engages a slot formed in the downward extending portion of the flange. The distance from the hinge to the cover top is less than the distance from the slot to the upper edge of the rear wall on which the cover top rests. Thus, rotation of the cover into the closed position with the hinge engaged causes elastic deformation of the hinge, thereby creating a spring force which clamps the cover onto the base. Elastic deformation in the flange imparts additional clamping force. Sufficient clearance is provided for this elastic deformation by either sloping the rearward extending portion of the flange or sloping the planar top of the cover.

U.S. Pat. No. 5,527,988 discloses a tank for an oil-filled pad-mounted electrical distribution transformer. The tank includes a front plate and a side panel unit connected to the front plate. The side panel unit is formed of a bent sheet of metal. Two of the side panels form obtuse included angles with adjoining side panels. A floor plate of the tank is sized to fit inside of the side panel unit so as to be capable of being secured at any desired elevation. The floor plate includes reinforcing channels.

U.S. Pat. No. 6,114,624 discloses a pad-mounted distribution transformer tank, wherein hem-bend flanges are constructed upper edge of the front terminal panel to act as a heat shield to protect the painted surface during the welding operation on the cover. Hem-bend flanges are also utilized on the sidewalls of the tank to improve the structural strength of the tank flange.

U.S. Pat. No. 6,422,612 discloses a door latch mechanism for pad-mounted transformer cabinet, in the form of a shaped plate including rod apertures at opposing ends for connecting with the latch rods and a door handle aperture intermediate the rod apertures for fastening to the cabinet operating door handle. A door stop in the form of a U-shaped rod is positioned on the bottom of the cabinet door frame to hold the cabinet door in the open position until and unless one end is released from the door bottom.

Lastly, U.S. Pat. No. 2003/0102141 Pat. Application discloses an improved pad-mount transformer enclosure for a 3-phase pad-mount distribution transformer or the like, having a wiring compartment utilizing multiple hinge points on each side panel with an additional set of hinges located at the back of the compartment area to allow the doors to be opened as normal or to allow the sides to be also opened, allowing the wiring compartment to be totally exposed on all three sides. The tank of the transformer enclosure may have a cover secured in a manner that allows the cover to be removed with simple hand tools while preventing unauthorized removal thereof, that increases tank top structural rigidity, and that does not trap water on the tank cover.

Despite of all the improvements that have been done over the past years to the ground level transformers, as well as to their related components, a system which is modular and which is coupled to a self-assembly cabinet has not been reported in the related art. Thus, it is an object of the present invention to propose a functional improved system comprising a modular tank coupled to a self-assembly cabinet for ground level transformers. The characteristic design of such a system allows attaining substantial economical savings due to reduced oil consumption, as well as due to a smaller requirement of materials for the construction of the tank and associated reduced assembly times, when compared with conventional tank configurations.

It is a further object of the present invention to provide a modular tank coupled to a self-assembly cabinet for ground level transformers whose materials and fabrication costs are reduced in at least 5% compared to conventional cabinet configurations.

It is a further object of the present invention to provide a modular tank coupled to a self-assembly cabinet for ground level transformers whose improved design allows achieving a substantial reduction in the total number of parts needed for its assemblage, from the 250 pieces used in conventional cabinet configurations to 74 pieces used in the new design.

It is a further object of the present invention to provide a modular tank coupled to a self-assembly cabinet for ground level transformers whose constituting parts are automatically fixed to each other during the cabinet assembly, so that the only pieces that need additional fixation means are the door locks.

It is a further object of the present invention to provide a modular tank coupled to a self-assembly cabinet for ground level transformers whose assembly requires using a reduced number of different parts compared to conventional cabinet configurations.

It is a further object of the present invention to provide a modular tank coupled to a self-assembly cabinet for ground level transformers whose constituting parts can be readily made in existing machine shops.

It is a further object of the present invention to provide a modular tank coupled to a self-assembly cabinet for ground level transformers which can be manually assembled.

This and other objects and advantages of the present invention will become apparent from a reading of the attached specification and appended claims.

BRIEF SUMMARY OF THE INVENTION

The present invention is a modular tank coupled to a self-assembly cabinet for ground level transformers. The modular tank comprises two interconnected tanks, a front plate and a base. The first tank is larger than the second one and it contains the high tension elements.

The second tank contains the low tension elements. The front plate supports the electric contacts for both tanks. The base supports the first tank and allows lifting it above the ground.

The self-assembly cabinet for ground level transformer comprises a cover divided into two sections. The first section acts as a cover for the modular tank, while the second section acts as a cover for the cabinet. Both cover sections are joined together by means of a hinge mechanism, and are assembled by sliding them on top of the modular tank by means of a lateral rail mechanism. The self-assembly cabinet comprises also two lateral plates, two frontal plates which act as access ports, and a base fitted with a peripheral channel. The lateral and frontal plates are fitted and fixed into the peripheral channel of the base by means of a joining channel mechanism. The sliding cover is also fitted with a peripheral channel which can be fitted to the lateral and frontal plates.

In order to gain access to the electric contacts of the ground level transformer, the second section of the cover is lifted, releasing the frontal plates, and then the frontal plates are open towards the cabinet's front side.

Despite of all the improvements that have been done over the past years to the ground level transformers, as well as to their related components, a system which is modular and which is coupled to a self-assembly cabinet has not been reported in the related art. Thus, it is an object of the present invention to propose a functional improved system comprising a modular tank coupled to a self-assembly cabinet for ground level transformers. The characteristic design of such a system allows attaining substantial economical savings due to reduced oil consumption, as well as due to a smaller requirement of materials for the construction of the tank and associated reduced assembly times, when compared with conventional tank configurations.

It is a further object of the present invention to provide a modular tank coupled to a self-assembly cabinet for ground level transformers whose materials and fabrication costs are reduced in at least 5% compared to conventional cabinet configurations.

It is a further object of the present invention to provide a modular tank coupled to a self-assembly cabinet for ground level transformers whose improved design allows achieving a substantial reduction in the total number of parts needed for its assemblage, from the 250 pieces used in conventional cabinet configurations to 74 pieces used in the new design.

It is a further object of the present invention to provide a modular tank coupled to a self-assembly cabinet for ground level transformers whose constituting parts are automatically fixed to each other during the cabinet assembly, so that the only pieces that need additional fixation means are the door locks.

It is a further object of the present invention to provide a modular tank coupled to a self-assembly cabinet for ground level transformers whose assembly requires using a reduced number of different parts compared to conventional cabinet configurations.

It is a further object of the present invention to provide a modular tank coupled to a self-assembly cabinet for ground level transformers whose constituting parts can be readily made in existing machine shops.

It is a further object of the present invention to provide a modular tank coupled to a self-assembly cabinet for ground level transformers which can be manually assembled.

DETAILED DESCRIPTION OF THE INVENTION

Figure 1:
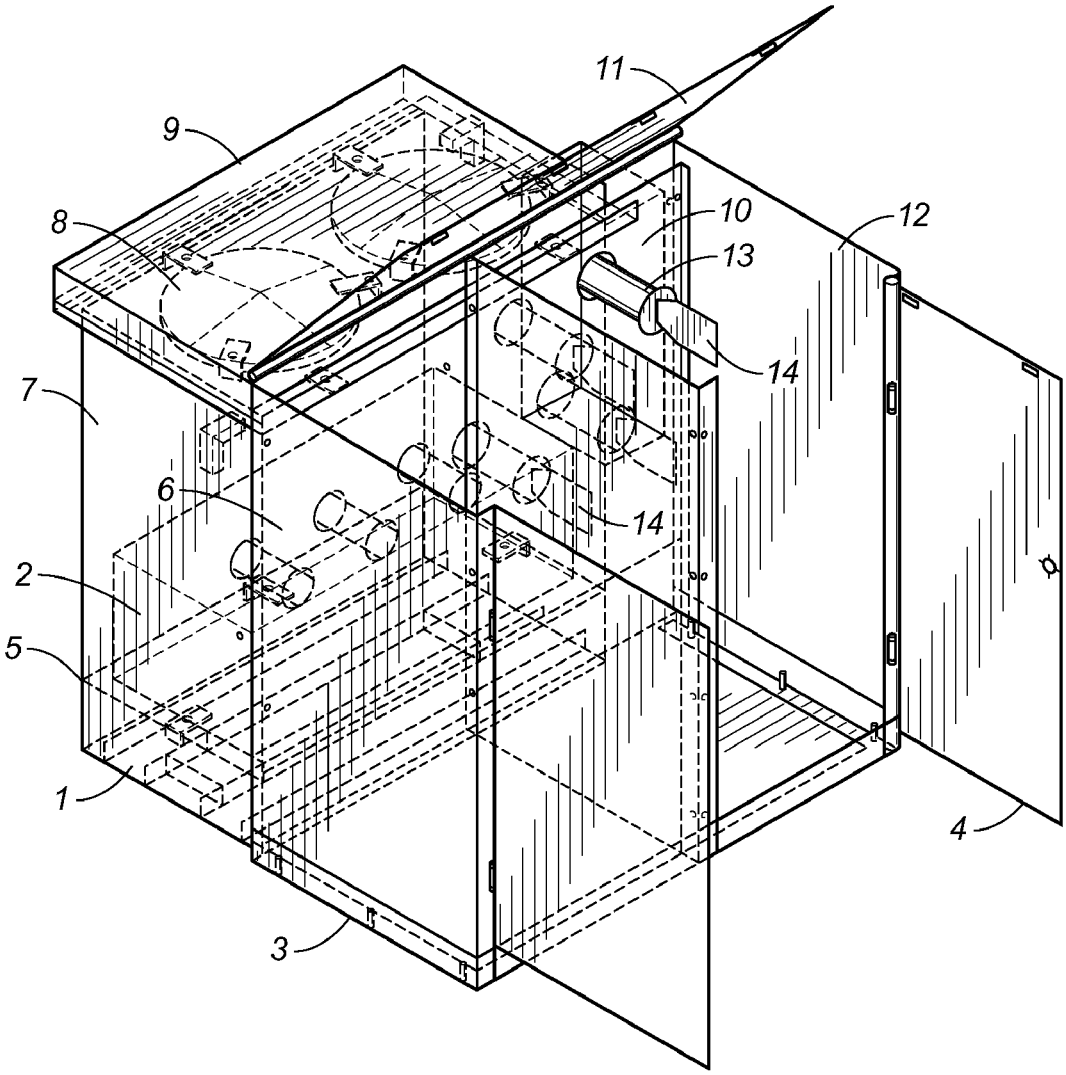
FIG. 1 is a perspective view of the modular tank with self-assembly cabinet for ground level transformer claimed in the present invention.

Referring to FIG. 1, the main components of the modular tank coupled to a self-assembly cabinet for ground level transformer claimed in the present invention are shown. Thus, base 1 is shown which comprises four channels (not shown) which are perpendicular to each other. The role of base 1 is to give support to the entire modular tank/cabinet assembly, allowing rotating it in the right or left directions. The core and coil 2 are the main components of the transformer and are responsible for the electrical capabilities of the latter. The core and coil 2 are immersed in an oil (not shown) in order to protect them from rusting and in general from the action of any external deleterious factors. Front sill 3 is used to fix, at ground level, the lateral walls and front doors of the cabinet. Left and right cabinet front doors 4 are used to restrict the entrance of unauthorized persons, animals or objects into the cabinet in order to impede their contact with any live electrical connections or parts. Tank bottom 5 provides support to core and coil 2. Front plate 6 supports all the electrical accessories as well as the high and low-tension terminals for the transformer.

Front plate 6 and tank bottom 5 are made from a single steel sheet, which is bent at an angle of 90° to form both pieces, which are then cut to their final shape and size. Tank walls 7 are used, in conjunction with front plate 6, to provide lateral protection to core and coil 2. Tank walls 7, front plate 6 and tank bottom 5 form together a reservoir which contains the oil used for the immersion of core and coil 2. Inspection cover 8 constitutes the upper cover of the cabinet. Inspection cover 8 is fitted with two holes which are used to inspect the core and coil 2. The tank upper cover 9 is used to protect the inspection cover 8. Oil-saving tank 10 is a small oil reservoir inside which the low-tension connectors are kept immersed in oil. Since front plate 6 is wider than the tank containing the core and coil 2, the oil-saving tank 10 is attached to one of the lateral walls of the latter tank and simultaneously to the back of front plate 6. The total volume resulting from adding together the volume of oil contained in the oil-saving tank 10 plus the volume of oil used for the immersion of core and coil 2, is considerably smaller than that used in conventional tank configurations, leading to substantial economical savings in oil consumption as well as in the amount of the materials required for the construction of the tanks due to the small size of the oil-saving tank 10. Cabinet cover 11 is used to cover the upper part of the cabinet, and it is connected to tank upper cover 9 by means of the upper cover connecting plates 9. Cabinet cover 11 is used also to secure the left and right cabinet front doors 4 once these are taken to their close position. Cabinet walls 12 are used to form the cabinet's enclosure, in conjunction with cabinet cover 11 and left and right cabinet front doors 4, the cabinet walls 12 constituting the lateral walls of said enclosure, which in turn is used to protect front plate 6 from the contact with unauthorized personnel, animals or objects, as well as from the weather conditions prevailing outdoors.

Figure 2:
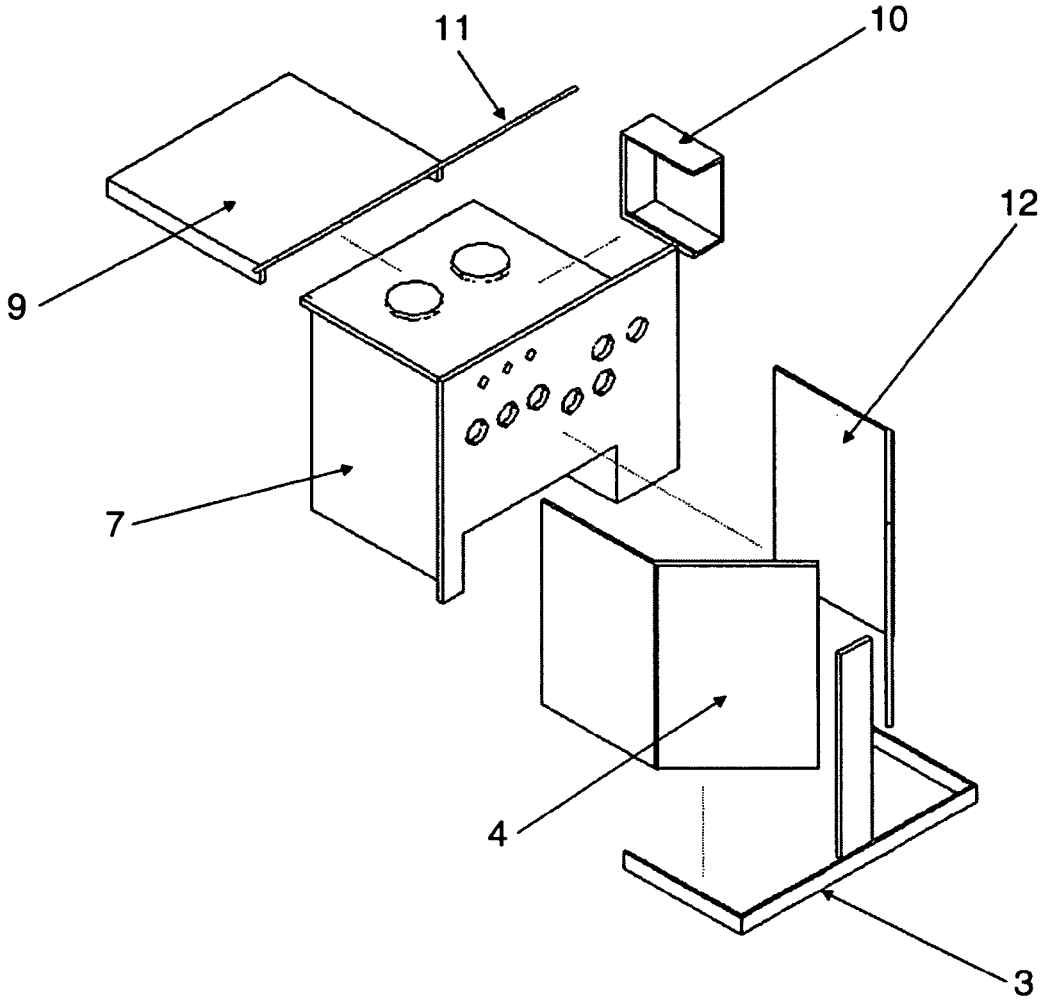
FIG. 2 is an exploded perspective view showing the assembly sequence of the cabinet according to the present invention.

Referring to FIG. 2, the cabinet's assembly sequence is as follows: After tank walls 7 are assembled, the oil-saving tank 10 is welded to it. Simultaneously and independently, the cabinet cover 11 is fitted to the tank upper cover 9; then, the front sill 3 is fitted to the tank walls 7 already joined by welding to oil-saving tank 10. Left and right cabinet front doors 4 are put into place in their open position and assembled to the assembly previously formed by assembling together the tank walls 7, the oil-saving tank 10 and the front sill 3. The assembly previously formed by assembling together the cabinet cover 11 and the tank upper cover 9 are slipped behind the assembly previously formed by assembling together the tank walls 7, the oil-saving tank 10, the front sill 3, and the right and left cabinet front doors 4, without closing down the cabinet cover 9. Right and left cabinet front doors 4 are closed. The cabinet cover 9 is closed down. Right and left cabinet front doors 4 are locked by means of a padlock.

Thus, as it has been shown, the present invention includes a modular tank coupled to a self-assembly cabinet for ground level transformers. The foregoing disclosure and description of the invention is illustrative and explanatory thereof. Various changes in the details of the present invention can be made within the scope of the appended claims without departing from its true spirit. The present invention should only be limited by the following claims and their legal equivalents.

We claim:

1. A modular tank apparatus comprising:

a first tank having a transformer core and coil therein, said first tank having a volume filled with oil in which said transformer core and coil are immersed in the oil, said first tank having a pair of lateral walls;

a front plate affixed to said first tank, said front plate having a width greater than a width of said first tank between said pair of lateral walls;

a second tank having low-tension elements therein, said second tank having a volume filled with oil in which the low-tension elements are immersed in the oil, said volume of said first tank being greater than said volume of said second tank, said second tank being affixed to one of said pair of lateral walls and to a portion of said front plate extending beyond said one of said pair of lateral walls;

a pair of cabinet walls fixedly connected to said front plate;

left and right cabinet front doors vertically hingedly connected to said pair of cabinet walls;

a base having a peripheral channel, said peripheral channel receiving a portion of said pair of cabinet walls therein and receiving a portion of said left and right cabinet front doors therein; and a sliding cover having a pair of sections, one of said pair of sections forming a cover over said first tank and said second tank, another of said pair of sections forming a cover over said left and right cabinet doors and said pair of cabinet walls.

2. The modular tank apparatus of claim 1, said front plate supporting electrical connections of said first and second tanks.

3. The modular tank apparatus of claim 1, said base being rotatable, said base being affixed to a bottom of said first tank so as to support said first tank above an underlying surface.

4. The modular tank apparatus of claim 1, said pair of sections being hingedly connected together such that said another of said pair of sections is rotatable upwardly and downwardly with respect to said one of said pair of sections.

5. The modular tank apparatus of claim 1, said another of said pair of sections being rotatable upwardly so as to expose said left and right cabinet doors.

* * * * *